US008851402B2

(12) United States Patent
Dinu et al.

(10) Patent No.: US 8,851,402 B2
(45) Date of Patent: Oct. 7, 2014

(54) FUEL INJECTION FOR GAS TURBINE COMBUSTORS

(75) Inventors: Constantin Dinu, Katy, TX (US); Mahesh Bathina, Andhra Pradesh (IN); Ramanand Singh, Uttar Pradesh (IN)

(73) Assignee: General Electric Company, Schenectady, NY (US)

( * ) Notice: Subject to any disclaimer, the term of this patent is extended or adjusted under 35 U.S.C. 154(b) by 991 days.

(21) Appl. No.: 12/369,808

(22) Filed: Feb. 12, 2009

(65) Prior Publication Data

US 2010/0199675 A1 Aug. 12, 2010

(51) Int. Cl.

| | |
|---|---|
| ***B05B 7/10*** | (2006.01) |
| ***F23R 3/28*** | (2006.01) |
| ***F23D 14/64*** | (2006.01) |

(52) U.S. Cl.

CPC ..... *F23R 3/286* (2013.01); *F23D 14/64* (2013.01)

USPC ..... 239/401

(58) Field of Classification Search

CPC ..... B05B 7/00; B05B 7/10; B05B 1/30

USPC ..... 239/88–95, 461, 463, 483, 490, 482, 239/424, 433, 533.2, 533.12, 584, 239/585.1–585.5; 251/127, 129.15, 129.21

See application file for complete search history.

(56) References Cited

U.S. PATENT DOCUMENTS

| | | | | |
|---|---|---|---|---|
| 2,984,420 | A * | 5/1961 | Hession, Jr. | 239/405 |
| 4,982,716 | A * | 1/1991 | Takeda et al. | 123/531 |
| 5,647,215 | A | 7/1997 | Sharifi et al. | |
| 6,065,691 | A * | 5/2000 | West | 239/407 |
| 6,345,601 | B1 * | 2/2002 | Miyajima et al. | 123/305 |
| 6,438,961 | B2 | 8/2002 | Tuthill et al. | |
| 6,668,557 | B2 | 12/2003 | Ohta et al. | |
| 6,755,024 | B1 * | 6/2004 | Mao et al. | 60/776 |
| 6,786,047 | B2 | 9/2004 | Bland et al. | |
| 6,993,916 | B2 | 2/2006 | Johnson et al. | |
| 7,490,471 | B2 | 2/2009 | Lynch et al. | |
| 7,908,864 | B2 | 3/2011 | Haynes et al. | |
| 8,220,270 | B2 | 7/2012 | Bathina et al. | |
| 2003/0115884 | A1 | 6/2003 | Boardman | |
| 2005/0028525 | A1 | 2/2005 | Toon et al. | |
| 2006/0260320 | A1 | 11/2006 | Bertolotti et al. | |
| 2007/0220898 | A1 | 9/2007 | Hessler | |

OTHER PUBLICATIONS

Chinese Office Action for CN Application No. 201010121889.0, dated Jan. 27, 2014, pp. 1-10.

Japanese Office Action for JP Application No. 2010-026028, dated Dec. 3, 2013, pp. 1-4.

Chinese Office Action for CN Application No. 201010121889.0, dated May 9, 2013, pp. 1-14.

Chinese Office Action for CN Application No. 201010121889.0, dated Sep. 11, 2013, pp. 1-6.

Japanese Office Action for JP Application No. 2010-026028, dated Jul. 15, 2014, pp. 1-6.

* cited by examiner

*Primary Examiner* — Davis Hwu

(74) *Attorney, Agent, or Firm* — Cantor Colburn LLP

(57) ABSTRACT

An injector includes a surface and an injector hole formed in the surface. The injector also includes a groove formed in the surface, the groove surrounding the injector hole.

18 Claims, 4 Drawing Sheets

FUEL INJECTION FOR GAS TURBINE COMBUSTORS

BACKGROUND OF THE INVENTION

The subject matter disclosed herein relates to gas turbines and, in particular, to fuel injection for gas turbine combustors.

In a typical combustor for a gas turbine, fuel is introduced by cross flow injection with respect to an input air stream. A relatively small reduction in the magnitude and/or severity of the issues associated with cross flow injection can be achieved by varying the angle of the fuel jet, and/or by using non-conventional designs for the fuel discharge holes. Nevertheless, a fuel jet in cross flow creates a recirculation zone or bubble located behind the fuel jet. The size of this recirculation bubble depends on many factors, including jet diameter and momentum ratio between the jet and mainstream flow. The recirculation bubble normally increases in size with the diameter and momentum of the fuel jet. When a fuel jet is introduced in cross flow, fuel may become entrained behind the fuel jet, leading to a flammable mixture in the recirculation zone or bubble behind the jet. Flame holding can occur in this region, leading to hardware damage. Also, a boundary layer disruption by the fuel jet can lead to flow separation on the nozzle center body, on the vane, and in the diffusers. A propensity to a fuel rich boundary layer, which leads to flame holding or flashback, also exists.

BRIEF DESCRIPTION OF THE INVENTION

According to one aspect of the invention, an injector includes a surface and an injector hole formed in the surface. The injector also includes a groove formed in the surface, the groove surrounding the injector hole.

According to another aspect of the invention, a fuel injector includes a surface that bounds a flow path of a fluid, and a fuel injector hole formed in the surface. The fuel injector also includes a groove formed in the surface, the groove surrounding the fuel injector hole.

According to yet another aspect of the invention, a fuel injector includes a body having a surface, a fuel injector hole formed at least through a portion of a thickness of the body. The fuel injector also includes a groove formed in the surface, the groove surrounding the fuel injector hole.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features and advantages of the invention are apparent from the following detailed description taken in conjunction with the accompanying drawings in which:

FIG. 2, including

FIG. 3, including

The detailed description explains embodiments of the invention, together with advantages and features, by way of example with reference to the drawings.

DETAILED DESCRIPTION OF THE INVENTION

Figure 1:
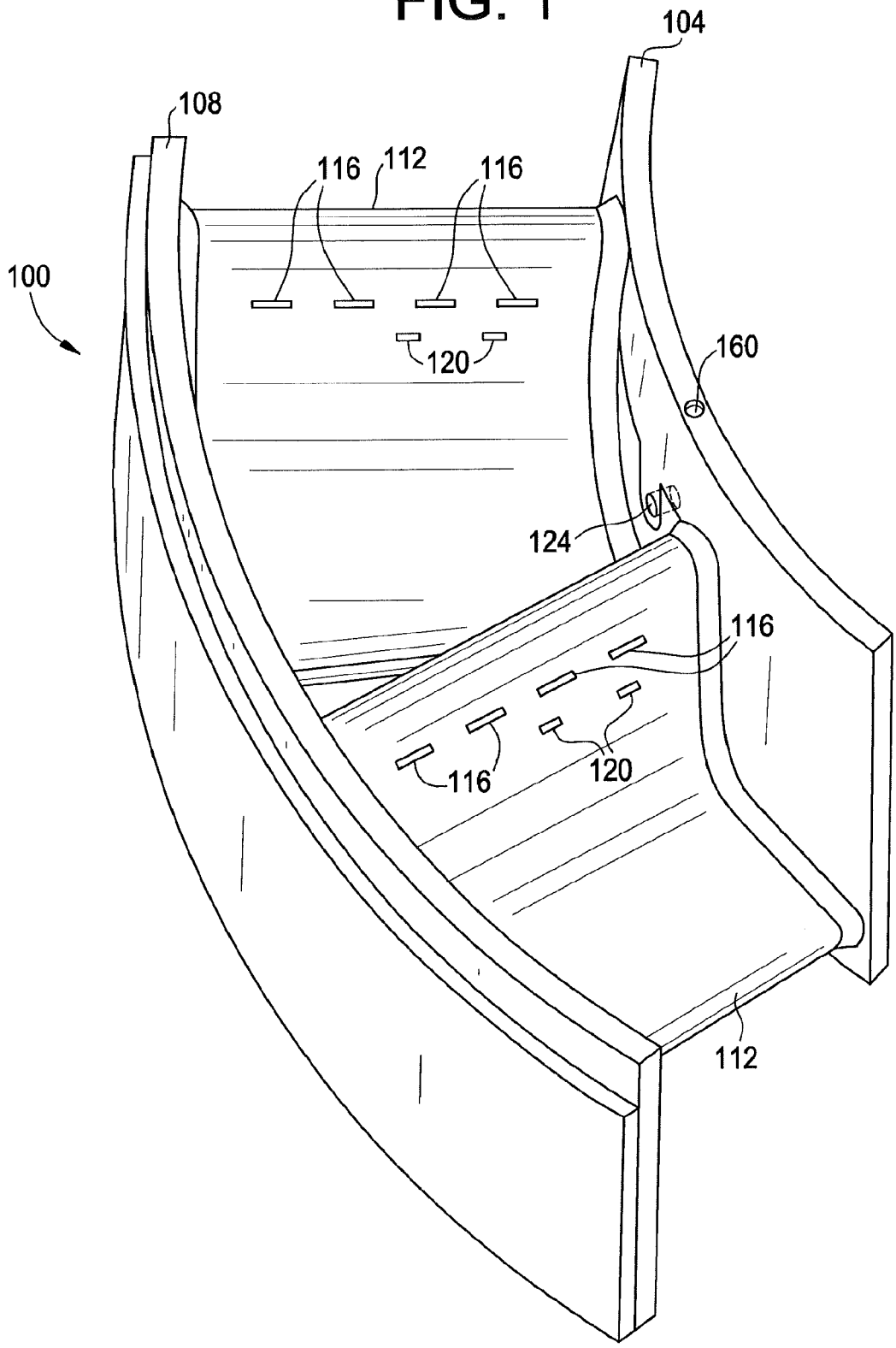
FIG. 1 is a perspective view of a portion of an air swirler or turning vane swozzle assembly of a premixer that is part of a combustor for a gas turbine according to an embodiment of the invention.

Various embodiments of the present invention control the development of a fuel jet in cross flow with an input air stream and can be applied in many types of fuel nozzles, regardless of the location of the fuel injection holes described hereinafter. In FIG. 1 is a portion of an air swirler or turning vane swozzle assembly 100 of a premixer that is part of a combustor for a gas turbine according to an embodiment of the invention. The combustion air is typically delivered by an inlet flow conditioner in a known manner to the swozzle assembly 100. In FIG. 1, the direction of that airflow is typically downward, but may be angled somewhat instead of directly downward.

The swozzle assembly 100 includes an inner center body or hub 104 and an outer shroud 108, with the hub 104 and shroud 108 connected by a series of airfoil shaped turning vanes or airfoils 112, which impart swirl to the combustion air passing through the swozzle assembly 100. Each turning vane 112 contains both a primary fuel supply passage as is known in the art and a secondary fuel supply passage, both passages typically formed through the core of the airfoil or vane 112. The fuel passages distribute fuel to a series of primary gas fuel injection holes 116 and a series of secondary gas fuel injection holes 120, which penetrate the wall of the airfoil or vane 112 and provide fuel outward in cross flow with the downward flowing combustion air. These fuel injection holes 116, 120 may be located on the pressure side, the suction side, or both sides of the turning vanes 112. Fuel enters the swozzle assembly 100 through inlet ports and annular passages as is known in the art, which feed the primary and secondary turning vane passages 116, 120, respectively. The fuel begins mixing with combustion air in the swozzle assembly 100, and fuel/air mixing is completed in the annular passage (not shown), which is formed by a swozzle hub extension and a swozzle shroud extension as is known in the art. After exiting the annular passage, the fuel/air mixture enters the combustor reaction zone where combustion takes place.

If the swozzle assembly 100 injects fuel through the holes 116, 120 in the pressure side of the aerodynamic turning vanes 112, the disturbance to the airflow field is reduced. However, a small recirculation bubble downstream of the fuel jet can still exist. In addition, a fuel rich boundary layer that can promote flashback may develop. The same disadvantages apply if some of the fuel injection holes 116, 120 are located on the suction side of the vanes 112. In addition, the recirculation bubble can increase in size at the same overall flow conditions and flow separation can be induced by the fuel jet.

In FIG. 1 are details of the geometry of the swozzle assembly 100. As noted, there are two groups of fuel injection holes 116, 120 on the surface of each turning vane 112, including the primary fuel injection holes 116 and the secondary fuel injection holes 120. Fuel is fed to these fuel injection holes through the primary and secondary gas passages, respectively. Fuel flow through these two injection paths is controlled independently, enabling control over the radial fuel/air concentration distribution profile from the swozzle hub 104 to the swozzle shroud 108.

Figure 2A:
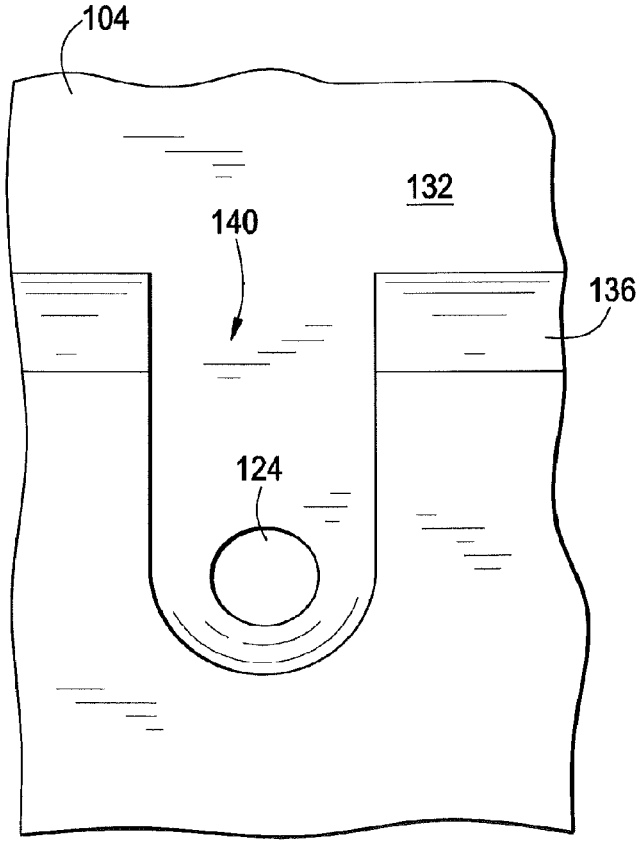
FIGS. 2A and 2B, are front and side views, respectively, of a fuel injector portion of the premixer of FIG. 1 according to an embodiment of the invention.
Figure 2B:
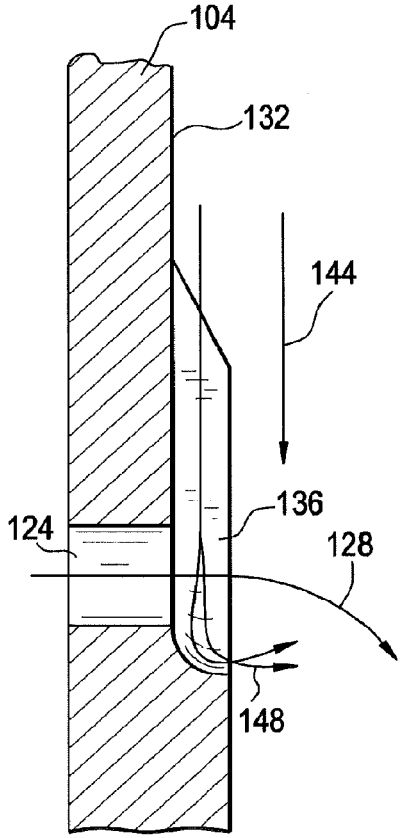

In FIG. 1, together with FIGS. 2A and 2B, is the center body or hub 104, which includes an additional fuel injector hole 124 in accordance with an embodiment of the invention. The hole 124 may be cylindrical in shape, and in an embodiment the hole 124 is formed throughout the entire thickness of the hub 104, as shown in FIGS. 2A and 2B. However, the hole 124 may take on any other suitable shape. A line with an arrowhead 128 depicts the flow of fuel through the hole 124 from inside the hub 104 and through the hub 104 and into the spacing between the hub 104 and the shroud 108 where a pair of the turning vanes 112 is located (i.e., the "fuel jet" 128). An inner wall 132 of the hub 104 that faces the shroud 108 (which functions as a boundary surface 132 of the hub 104) includes a portion 136 that protrudes outwardly and also in which a groove 140 is formed as a channel in an embodiment, the surface of the protrusion 136 also forming part of the boundary surface of the hub 104. In an embodiment, the fuel injection hole 124 is formed near the approximate bottom of the groove 140.

In an embodiment, the bottom of the groove 140 (as viewed in FIGS. 2A and 2B) may begin just below the fuel injection hole 124 and extends along the surface of the outer wall 132 of the hub 104 in the upstream direction relative to the main air stream, which is indicated in FIG. 2B by the line with the arrowhead 144. Thus, the main air stream 144 is in cross flow with the fuel exiting the fuel injection hole 124. The relatively greatest benefit is obtained if the groove 140 is roughly aligned with the local main airflow direction 144. The airflow expands into the available flow area and thus the airflow will eventually fill in the groove 140, as indicated by the lines with arrowheads 148. The air trapped inside the groove 140 flows along the channel defined by the groove 140. In proximity to the fuel jet 128, the airflow is blocked by the fuel jet 128 and is limited by the sidewalls of the groove 140. If the groove 140 is wider than the fuel jet 128, the airflow in the channel 140 will move around the fuel jet 128 due to an increased pressure gradient caused by the low pressure generated behind the fuel jet 128 (and where a recirculation bubble would normally form). At the bottom of the groove 140 downstream of the fuel jet 128 (as viewed in FIGS. 2A and 2B) the airflow trapped in the channel 140 will be ejected into the main stream (in the recirculation region downstream of the fuel jet 128), as indicated by the lines 148. Thus, fresh air is added to this region, preventing flame holding. The amount of airflow discharged in this region depends on the size of the groove 140. Furthermore, depending on the shape of the bottom of the groove 140, the channel airflow 148 can be discharged normal to the wall 132 (FIG. 2B) or directed along the wall 132 (FIG. 3B) to strengthen the boundary layer and avoid flow separation and/or a fuel rich boundary layer.

Figure 3A:
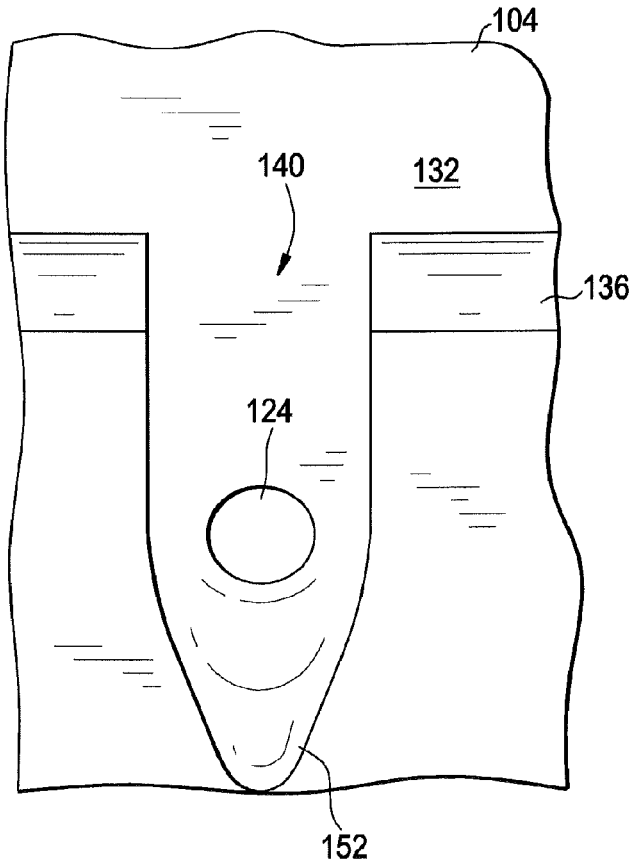
FIGS. 3A and 3B, are front and side views, respectively, of a fuel injector portion of the premixer of FIG. 1 according to another embodiment of the invention.
Figure 3B:
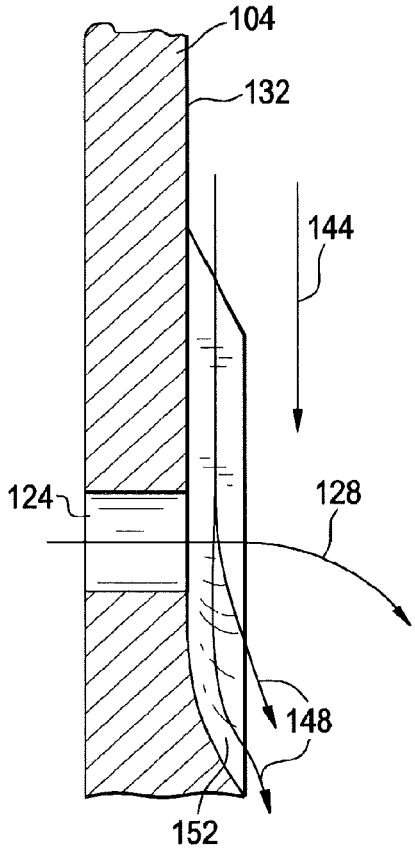

FIGS. 3A and 3B are front and side views, respectively, of a fuel injector portion of the swozzle assembly 100 of FIG. 1 according to another embodiment of the invention. As this embodiment is somewhat similar to the embodiment of FIGS. 2A and 2B, like reference numerals refer to like elements. The difference between the embodiment of FIGS. 3A and 3B and that of FIGS. 2A and 2B is that the groove 140 is extended farther downward in a section 152 that terminates in a "V"-shaped configuration. Although not shown in FIG. 3B, a fuel recirculation bubble may be formed, but in this embodiment the bubble will not attach itself to the surface 132 of the inner wall of the hub 104, thereby preventing the occurrence of any flame holding. The embodiment of FIGS. 3A and 3B illustrates the fact that by controlling the shape of the groove 140 formed in the wall 132 of the hub 104, the direction of the channel airflow can be controlled. In FIG. 3B, the channel airflow 148 is directed along the wall 132 in contrast to that in FIG. 2B where the channel airflow is discharged normal to the wall 132.

In an alternative embodiment, fuel may be introduced into the hub 104 (FIG. 1) through a hole 160 formed in a top surface of the hub. One or more fuel circuits may be formed internal to the body of the hub 104 to direct the fuel to the fuel injection hole 124 for ejection outwardly therefrom as described above.

The groove 140 can be formed in the protrusion 136 as shown in FIGS. 2 and 3 or can be imprinted in the outer surface 132 of the hub. The groove only needs to be long enough to get filled with air upstream of the fuel discharge hole. Computational Fluid Dynamics (CFD) has been used to verify the anticipated behavior of the flow trapped inside the groove 140.

Figure 4:
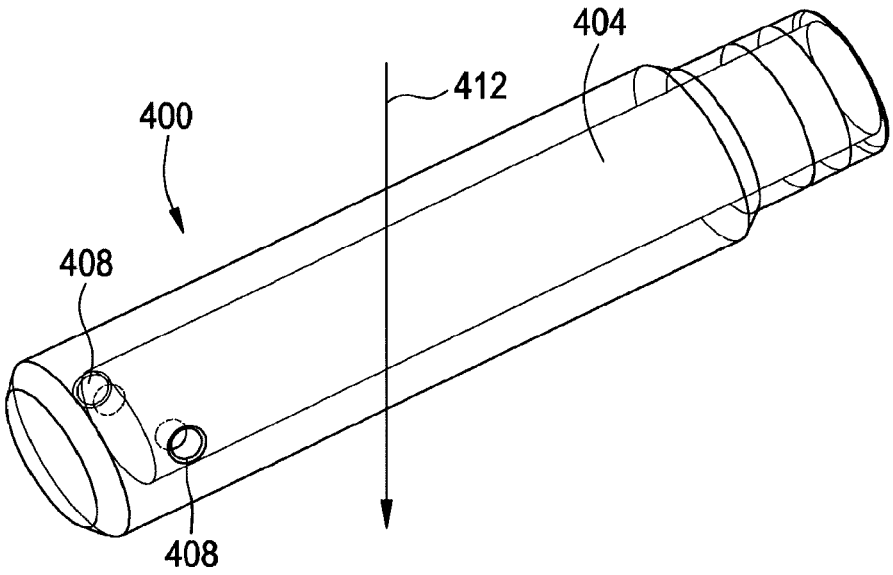
FIG. 4 PRIOR ART
FIG. 4 is a perspective view of a fuel injector peg according to the prior art.

In FIG. 4 is a prior art fuel injector peg 400. The peg 400 is typically part of a premixer portion of a combustor of a gas turbine. The peg 400 may be supported at one end (e.g., the right end as viewed in FIG. 4) by a casing of the burner in known fashion, or the peg 400 may be supported at both ends by the casing and by, for example, a centrally located diffusion burner. Further, a plurality of pegs 400 may be provided. The peg 400 is shown as being cylindrical in shape, but can be of any suitable shape. The peg 400 functions to provide fuel from a fuel supply that travels down a length 404 of the peg 400 (i.e., from right to left as viewed in FIG. 4) and exits the peg 400 from, e.g., two openings 408. More or less than two openings 408 may be provided, and the openings may be oriented with respect to each other in any manner. The fuel jet that exits each of the openings 408 is typically oriented at some angle (e.g., 45 degrees, 90 degrees, etc.) with respect to an incoming airflow 412. The fuel then mixes to some extent with the airflow and is then typically provided to a chamber within the premixer where further mixing commonly takes place.

An issue with this prior art peg design is that the fuel jet in cross flow creates a recirculation zone or bubble located behind the fuel jet. As previously mentioned, the size of this recirculation bubble depends on many factors, including jet diameter and momentum ratio between the jet and mainstream flow. The recirculation bubble normally increases in size with the diameter and momentum of the fuel jet. When a fuel jet is introduced in cross flow, fuel may become entrained behind the fuel jet, leading to a flammable mixture in the recirculation zone or bubble behind the jet. Flame holding can occur in this region, leading to damage of, e.g., the premixer.

Figure 5:
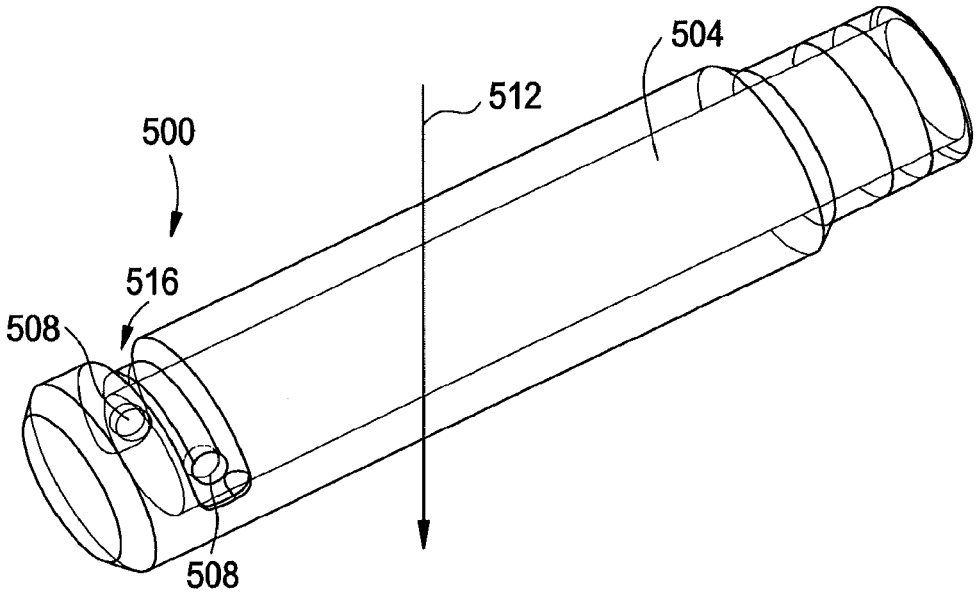
FIG. 5 is a perspective view of a fuel injector peg in accordance with an embodiment of the present invention.

In FIG. 5 is a fuel injector peg 500 in accordance with an embodiment of the present invention. The peg 500 of this embodiment is somewhat similar to the peg 400 of the prior art in that a fuel flow is provided down the length 504 of the peg 500 and each fuel jet exits through an associated opening 508, wherein each fuel jet is in a cross flow angular orientation to the incoming air stream 512. The primary difference with the peg 500 of the embodiment of FIG. 5 is that now a groove 516 is formed in the surface of the peg 500. As shown in FIG. 5, in an embodiment the groove 516 is formed the entire circumferential length between the two openings 508, thereby connecting these openings. The purpose of the groove 516 is similar to the groove 140 of the embodiments of FIGS. 2 and 3, described hereinabove. That is, some of the air from the incoming air stream 512 gets trapped within the groove 516 and moves within the groove 516 and is ultimately ejected therefrom and into the main air stream. This prevents the formation of a recirculation bubble and, thus, the occurrence of flame holding in areas behind the fuel jets exiting the openings 508.

While embodiments of the invention have been described in reference to the outer surface 132 of a hub 104, it should be appreciated that various embodiments of the invention may be employed into any other surface that bounds the flow path and can be used for fuel injection (for example, shrouds or even the turning vanes).

Embodiments of the present invention control the development of a jet in cross flow and can be applied in all fuel nozzles, regardless of the location of the fuel injection holes. In addition, embodiments of the invention provide for fuel injection that improves the performance characteristics associated with such fuel injection (for example, fuel jet penetration and fuel/air mixing characteristics). Also provided is a robust mechanism to control and assist fuel jet development in cross flow. At the same time the main disadvantages associated with cross-flow injection are eliminated, for example, a recirculation bubble located behind the jet, which when a fuel jet is introduced in cross flow, fuel gets entrained behind the fuel jet leading to a flammable mixture in the recirculation bubble behind the jet and destructive flame holding can occur in this region. Embodiments of the invention do not allow the recirculation bubble to form or control the volume and/or the fuel-to-air ratio inside the recirculation bubble.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An injector comprising:

a first surface;

a groove formed in the first surface, the groove comprising a second surface, the groove receiving a first flow being substantially air; and an injector hole materially and integrally formed in the groove through the second surface of the groove, wherein the injector hole forms a second flow that enters directly into the groove to intersect with the first flow with the first flow, the second flow being substantially fuel.

2. The injector of claim 1, the surface comprising a boundary surface of a swozzle assembly.

3. The injector of claim 1, the surface comprising a surface of a peg.

4. The injector of claim 1, the injector hole comprising a suitably shaped hole.

5. The injector of claim 1, the second flow exiting the injector hole at an angle with respect to the first flow passing through the groove.

6. The injector of claim 5, the groove being aligned with a direction of the first flow.

7. A fuel injector comprising:

a first surface;

a groove formed in the first surface, the groove comprising a second surface, the groove receiving an air flow; and an injector hole materially and integrally formed in the groove through the second surface of the groove, wherein the injector hole forms a fuel flow that exits the injector hole to intersect with the air flow at an angle in the groove.

8. The fuel injector of claim 7, the surface comprising a boundary surface of a swozzle assembly.

9. The fuel injector of claim 7, the surface comprising a surface of a peg.

10. The fuel injector of claim 7, the fuel injector hole comprising a suitably shaped hole.

11. The fuel injector of claim 7, the groove being aligned with a direction of the flow of air.

12. A fuel injector comprising:

a body having a first surface;

a groove formed in the first surface, the groove comprising a second surface, the groove receiving a first flow being substantially air; and a fuel injector hole formed at least through a portion of a thickness of the body, the fuel injector materially and integrally formed in the groove through the second surface of the groove, wherein the injector hole forms a second flow that enters directly into the groove to intersect with the first flow, the second flow being substantially fuel.

13. The fuel injector of claim 12, the body comprising a portion of a swozzle assembly.

14. The fuel injector of claim 12, the body comprising a peg.

15. The fuel injector of claim 12, the second flow passing through the fuel injector hole and exiting the fuel injector hole, and the first flow passing through the groove, the second flow exiting the fuel injector hole at an angle with respect to the first flow passing through the groove.

16. The fuel injector of claim 15, the groove being aligned with a direction of the first flow of air.

17. The injector of claim 1, wherein the surface comprises a surface of a body, wherein the groove and injector hole are both formed in the surface of the body.

18. The injector of claim 1, wherein a path for the first flow is substantially perpendicular to a path for the second flow.

* * * * *